US009657442B2

(12) United States Patent
Trouve

(10) Patent No.: US 9,657,442 B2
(45) Date of Patent: May 23, 2017

(54) AQUEOUS GLYOXYL-BASED INSOLUBILIZER COMPOSITION FOR THE SURFACE TREATMENT OF PAPER AND CARDBOARD

(71) Applicant: Claude Trouve, Compiegne (FR)

(72) Inventor: Claude Trouve, Compiegne (FR)

(73) Assignee: ARCHROMA IP GMBH (CH)

( * ) Notice: Subject to any disclaimer, the term of this patent is extended or adjusted under 35 U.S.C. 154(b) by 418 days.

(21) Appl. No.: 13/850,859

(22) Filed: Mar. 26, 2013

(65) Prior Publication Data

US 2013/0213266 A1 Aug. 22, 2013

Related U.S. Application Data

(62) Division of application No. 12/085,815, filed as application No. PCT/EP2006/068822 on Nov. 23, 2006, now abandoned.

(30) Foreign Application Priority Data

Dec. 2, 2005 (FR) ..... 05 12250

(51) Int. Cl.
*D21H 25/02* (2006.01)
*D21H 19/44* (2006.01)

(52) U.S. Cl.
CPC ..... *D21H 25/02* (2013.01); *D21H 19/44* (2013.01); *Y10T 428/31996* (2015.04)

(58) Field of Classification Search
None
See application file for complete search history.

(56) References Cited

U.S. PATENT DOCUMENTS

| | | | | |
|---|---|---|---|---|
| 3,615,185 | A * | 10/1971 | Jacobs et al. | 423/267 |
| 3,642,774 | A * | 2/1972 | Schobinger et al. | 536/103 |
| 3,903,035 | A | 9/1975 | Affeldt et al. | |
| 4,258,104 | A | 3/1981 | Lee et al. | |
| 5,015,711 | A | 5/1991 | Simonet et al. | |
| 5,395,440 | A * | 3/1995 | Trouve | 106/287.25 |
| 5,401,562 | A * | 3/1995 | Akao | 428/211.1 |
| 2005/0191449 | A1 * | 9/2005 | Funato et al. | 428/34.1 |

FOREIGN PATENT DOCUMENTS

| | | |
|---|---|---|
| DE | 2 250 977 A1 | 4/1974 |
| WO | 2004/025026 A1 | 3/2004 |

OTHER PUBLICATIONS

International Search Report dated Jul. 4, 2011, issued in Application No. PCT/EP2011/002497.
International Preliminary Report on Patentability dated Nov. 27, 2012, issued in Application No. PCT/EP2011/002497.

* cited by examiner

*Primary Examiner* — Callie Shosho
*Assistant Examiner* — Patrick English
(74) *Attorney, Agent, or Firm* — McBee Moore Woodward & Vanik IP, LLC

(57) ABSTRACT

The invention relates to an aqueous insolubilizer composition intended for the surface treatment of paper and cardboard, comprising a mixture composed of glyoxal and of at least one alkali metal orthophosphate, and also its use.

15 Claims, No Drawings

AQUEOUS GLYOXYL-BASED INSOLUBILIZER COMPOSITION FOR THE SURFACE TREATMENT OF PAPER AND CARDBOARD

CROSS REFERENCE TO RELATED APPLICATION

This application is a divisional application of U.S. Patent application Ser. No. 12/085,815, filed May 29, 2008, now abandoned entitled "Aqueous Glyoxyl-Based Insolubilizer Composition For The Surface Treatment Of Paper And Cardboard," the entirety of which is hereby incorporated herein by reference.

The present invention relates to insolubilizer compositions for the surface treatment of paper and/or cardboard and their application in the paper industry.

In the paper industry, it is known to modify the surface finish of paper depending on the desired applications. Thus, for certain usages, especially for offset printing, a paper is needed having not only rigidity and opacity, but also a surface that produces good printing while possessing good wet rub, wet picking, lifting and dusting resistance and also a satisfactory inertness to water. In order to achieve this, it is proposed to treat the papers with coating slips containing, amongst other things, mineral pigments and/or fillers such as titanium dioxide, clays or calcium carbonates combined in certain cases with binders of the type: starch, casein, modified starch or else latices of the SBR type for example.

The hydrophilic nature of the binder requires use of an insolubilizer which crosslinks the binder, thus making it more hydrophobic, and thus improves the surface properties of the treated paper.

The introduction of glyoxal, aminoplast resins based on urea and/or melamine and formaldehyde, glyoxal or else glyoxal-formaldehyde mixtures, and sometimes of zirconium salts, into the coating slips is described in Patents U.S. Pat. Nos. 3,869,296, 3,197, 659, 4,343,655, 4,455,416 and 4,471,087.

However, these insolubilizing agents have numerous disadvantages. The aminoplast resins comprising formaldehyde liberate the latter in the course of the treatments, which makes their use incompatible with certain legislations, especially for the known allergenic and irritant effects of formaldehyde.

The zirconium salts are practically ineffective with starches. Glyoxal has excellent insolubilization properties, but it cannot be used in alkaline coating slips.

Furthermore, the papers coated with coating slips comprising glyoxal in free or combined state yellow easily and cannot tolerate high drying temperatures.

Patent Application EP-A-0 637 644 describes insolubilizer compositions comprising, in aqueous solution, a mixture constituted of glyoxal, urea, an alkali metal salt of an oxygen-containing acid of boron and an alkali metal or alkaline-earth metal hydroxide. However, these compositions have a very high glyoxal content.

Still sought after are insolubilizer compositions that can be used in the treatment of paper and cardboard surfaces having the lowest possible glyoxal content without at the same time decreasing the inertness to water, the wet rub, wet picking, dusting and lifting resistance, and without spoiling the whiteness of the treated papers.

One subject of the present invention is an aqueous insolubilizer composition intended for the surface treatment of paper and cardboard, comprising a mixture composed of glyoxal and of at least one alkali metal orthophosphate, the pH of said composition being below 7.

As the orthophosphate which may be used in the compositions according to the invention, sodium, potassium and lithium orthophosphates, for example, may be cited. As examples, mention may be made of the following specific compounds: lithium dihydrogen phosphate ($LiH_2PO_4$), monosodium orthophosphate ($NaH_2PO_4$), disodium orthophosphate ($Na_2HPO_4$), trisodium orthophosphate ($Na_3PO_4$), hemisodium orthophosphate ($NaH_5(PO_4)_2$), monopotassium orthophosphate ($KH_2PO_4$), dipotassium orthophosphate ($K_2HPO_4$) and tripotassium orthophosphate ($K_3PO_4$).

According to the invention, the alkali metal orthophosphates may be used alone on in combination.

The alkali metal orthophosphates that can be used according to the invention are commercially available and may be used according to the invention in either their anhydrous or hydrated form.

Advantageously, a sodium orthophosphate will be used and, more particularly, trisodium orthophosphate dodecahydrate, also called trisodium monophosphate dodecahydrate.

One subject of the invention is, more particularly, compositions as defined above which comprise, in aqueous solution, an alkali metal orthophosphate/glyoxal weight ratio between about 0.35 and 1.75, preferably between about 0.5 and 1.2 and more particularly between about 0.8 and 1.

Among the latter compositions, mention may be made of those characterized in that they have a solids content between about 20% and 60% by weight, preferably between about 35% and 45% by weight and more particularly about 40% by weight.

A key feature of the compositions according to the invention is the pH of said compositions, which must be below 7 to prevent degradation of the glyoxal.

Certain alkali metal orthophosphates have, in aqueous solution, a fairly acidic pH, such as sodium monophosphate ($NaH_2PO_4$), whereas others are fairly basic, such as disodium phosphate ($Na_2HPO_4$) or trisodium phosphate ($Na_3PO_4$).

In certain cases and depending on the alkali metal orthophosphates used, it is necessary to adjust the pH of said compositions to a value below 7, preferably between 3 and 6, more particularly between 4 and 5, by addition of an acid. For example, inorganic acids or carboxylic acids may be employed.

As carboxylic acid, mention may be made of acetic acid or else citric acid.

Preferably, a mineral acid such as hydrochloric acid, sulphuric acid and more particularly phosphoric acid is used.

One subject of the invention is especially compositions that contain, in aqueous solution, a trisodium orthophosphate dodecahydrate/glyoxal weight ratio between about 0.35 and 1.75, preferably between about 0.5 and 1.2 and more particularly between about 0.8 and 1.

Among the latter compositions, mention may be made of those that have a solids content between about 20% and 60% by weight, preferably between about 35% and 45% by weight and more particularly about 40% by weight.

The compositions according to the invention may be obtained by simple mixing of their constituents in water.

The invention also relates to a method of preparing a composition as described above, comprising the steps consisting in:

introducing the desired quantity of alkali metal orthophosphate into an aqueous glyoxal solution;

if necessary, adding water, to adjust the percentage of solids in the composition; and if necessary, adjusting the pH of the composition to a value below 7 by addition of an acid.

The glyoxal used is preferentially in the form of a 20 wt % to 60 wt %, preferably 30 wt % to 50 wt %, aqueous solution.

More particularly, the compositions according to the invention are prepared from a 40 wt % aqueous glyoxal solution into which, with stirring and at room temperature, the desired quantity of alkali metal orthophosphate then water, if necessary to adjust the solids percentage of the composition, are introduced.

Under still more preferential conditions, the compositions according to the invention are obtained by introducing into the aqueous glyoxal solution, with stirring and at room temperature, the desired quantity of alkali metal orthophosphate, then the desired quantity of acid to adjust the pH to a value below 7 and lastly water, if necessary to adjust the solids percentage of the composition.

The compositions according to the invention have advantageous properties when they are introduced into coating slips based on mineral pigments and binder(s), intended for paper coating. They especially make it possible to improve the wet rub, wet picking, dusting and lifting resistance and also the inertness to water of papers treated with coating slips comprising the compositions according to the invention.

Furthermore, these improvements are obtained without spoiling the whiteness of the papers, despite the fact that they comprise glyoxal, which is known to turn paper yellow when the drying conditions are harsh. These properties justify their application in the paper industry for obtaining coating baths, such as coating slips, and the various size press coating formulations, intended especially for surface application onto papers.

Another subject of the invention is the coating baths comprising the above compositions, and also the papers obtained by the use of coating baths according to the invention.

One final subject of the invention is the use of at least one composition defined above for the surface treatment of paper or cardboard.

The examples below illustrate the invention, in a non-limiting manner.

EXAMPLE 1

Mixed, with stirring at room temperature, are:

112 g of a commercial aqueous 40 wt % glyoxal solution (Clariant), 30 g of 85 wt % phosphoric acid, 37 g of trisodium orthophosphate dodecahydrate, 88 g of water.

A clear solution is obtained having a pH of 3.5, a 37% solids content and a content of glyoxal 40 as such of 42%.

The trisodium phosphate dodecahydrate/glyoxal weight ratio is 0.83.

APPLICATION EXAMPLES

1/ Size Press Treatment

This treatment is carried out on a size press, comprising an assembly of rolls and between which the sheet passes to receive a uniform coating of slip.

A 14 wt % solution of oxidized starch C*5591 from Cerestar was used.

Various formulations C1 to C6 were prepared whose compositions are given in Table 1 below. The quantities are expressed in g of product as such.

The formulation C1 does not contain insolubilizer.

The formulations C4 to C6 correspond to the use of an insolubilizer composition as described in Example 1.

The formulations C2 and C3, as comparative examples, correspond to the use of a composition as described in EP-A-0 637 644 and having the following characteristics:

pH=3.5+/−0.5;

solids content=42+/−1%;

content of glyoxal 40 as such=86%;

sodium tetraborate decahydrate/glyoxal weight ratio=0.10.

TABLE 1

| | C1 | C2 | C3 | C4 | C5 | C6 |
|---|---|---|---|---|---|---|
| Starch | 200 | 200 | 200 | 200 | 200 | 200 |
| Insolubilizer (Comparative example) | | 3.5 | 7 | | | |
| Insolubilizer (Example 1) | | | | 3.5 | 7 | 14 |
| Proportion (Dry insolubilizer/dry starch) | | 5% | 10% | 5% | 10% | 20% |

In the examples, an uncoated wood-free paper was used, having a basis weight of 80 g/m$^2$, a Cobb$_{60}$ of 34.7 seconds and sold by ArjoWiggins.

Impregnation of the paper was carried out with the formulations C1 to C6, with a pick-up of about 20% as such using an SP 350 size press from Mathis, at a rate of 12 m/min and a pressure of 3 bar, followed by drying at 90° C. for 90 s. The Taber wet rub was then determined for the impregnated paper.

The Taber wet rub was carried out according to the modified French standard Q 03-055, with annular test pieces of exterior and interior diameters respectively of 120 and 7 mm, for 10 cycles and 20 cycles, CS-0 abrading wheels, under a pressure of 100 g, in the presence of 10 g of water, followed by rinsing with 10 g of water; these 20 g of water are recovered and made up to 25 g with water, then the turbidity of these 25 g of water is determined with a Hach turbidimeter. The turbidity observed is expressed in NTU units and the results obtained are in Table 2 below.

TABLE 2

| | C1 | C2 | C3 | C4 | C5 | C6 |
|---|---|---|---|---|---|---|
| Turbidity 10 cycles (NTU) | 87 | 17.5 | 13.5 | 22.5 | 10 | 7 |
| Turbidity 20 cycles (NTU) | 170 | 65 | 45 | 68 | 53 | 20 |

The results show that the composition of the invention has a starch-insolubilizing effect.

Furthermore, the results obtained show that the composition of the invention bestows wet rub resistance performances that are at least equivalent relative to the composition of the prior art, for the same quantity of active ingredient.

2/ Coating Treatment

A calcium carbonate sold by Omya, reference HYDROCARB® 90, a kaolin sold by Huber Engineered Materials, reference HYDRAGLOSS® 90, an SBR (styrene-butadiene) latex sold by Dow, reference DL 950, and an oxidized starch sold by Cerestar, reference C*5591, were used.

Various formulations C7 to C11 were prepared whose compositions are given in Table 3 below. The quantities are expressed in g of product as such.

The formulation C7 does not contain insolubilizer.

The formulations C10 and C11 correspond to the use of an insolubilizer composition as described in Example 1.

The formulations C8 and C9, as comparative examples, correspond to the use of a composition as described in EP-A-0 637 644 and having the following characteristics:

pH=3.5+/−0.5;

solids content=42+/−1%;

content of glyoxal 40 as such=86%;

sodium tetraborate decahydrate/glyoxal weight ratio=0.10.

TABLE 3

| | C7 | C8 | C9 | C10 | C11 |
|---|---|---|---|---|---|
| Calcium carbonate | 70 | 70 | 70 | 70 | 70 |
| Kaolin | 30 | 30 | 30 | 30 | 30 |
| Latex | 10 | 10 | 10 | 10 | 10 |
| Starch | 2 | 2 | 2 | 2 | 2 |
| Insolubilizer (Comparative example) | | 0.4 | 0.8 | | |
| Insolubilizer (Example 1) | | | | 0.4 | 0.8 |

In the examples, an uncoated wood-free paper was used, having a basis weight of 80 g/m$^2$, a Cobb$_{60}$ of 34.7 seconds and sold by ArjoWiggins.

Coating of the paper was carried out with the formulations C7-C11, with a deposit of about 20 g/m$^2$ using a Champion 010 coating bar, followed by drying at 105° C. in an oven for 1 minute. The Taber wet rub was then determined for the impregnated paper as described previously. A turbidity measurement was also carried out after oven treatment at 105° C., for 20 minutes in the press.

Whiteness measurements WCIE were also carried out using Minolta CM 3720/lamp D65/10 equipment.

The results obtained are reported in Table 4 below.

TABLE 4

| | C7 | C8 | C9 | C10 | C11 |
|---|---|---|---|---|---|
| Turbidity - 10 cycles before oven treatment (NTU) | 193 | 113 | 110 | 75 | 67 |
| Turbidity - 10 cycles after oven treatment (NTU) | 88 | 74 | 67 | 63 | 48 |
| Whiteness (%) | 84.2 | 83.6 | 84.5 | 83.5 | 85 |

The results obtained show that the insolubilizer composition of the invention, used in the coating treatment of paper, has advantageous properties regarding the resistance of the treated paper to wet rub.

It may also be observed that the compositions of the invention do not spoil the whiteness of the treated papers.

The invention claimed is:

1. A process for the surface treatment of paper or cardboard, comprising the step of contacting the paper or cardboard with an aqueous insolubilizer composition, wherein the aqueous insolubilizer composition comprises glyoxal and at least one alkali metal orthophosphate and wherein the pH of the aqueous insolubilizer composition is below 7.

2. The process according to claim 1, wherein said composition comprises, in aqueous solution, an alkali metal orthophosphate/glyoxal weight ratio between about 0.35 and 1.75.

3. The process according to claim 2, wherein said ratio is between about 0.5 and 1.2.

4. Paper or cardboard treated by the process of claim 3.

5. The process according to claim 2, wherein said ratio is between about 0.8 and 1.

6. The process according to claim 2, wherein the alkali metal orthophosphate comprises trisodium orthophosphate dodecahydrate.

7. Paper or cardboard treated by the process of claim 2.

8. The process according to claim 1, wherein the solids content of said composition is between about 20% and 60% by weight.

9. The process according to claim 1, wherein the solids content of said composition is between about 35% and 45% by weight.

10. The process according to claim 1, wherein the solids content of said composition is about 40% by weight.

11. The process according to claim 10, wherein the pH of said composition is adjusted to a value below 7 by addition of phosphoric acid.

12. The process according to claim 1, wherein the alkali metal orthophosphate comprises trisodium orthophosphate dodecahydrate.

13. Paper or cardboard treated by the process of claim 1.

14. The process according to claim 1, wherein the pH is between 3 and 6.

15. A process for improving the wet rub resistance of a paper or cardboard, comprising the step of contacting the paper or cardboard with an aqueous insolubilizer composition, wherein the aqueous insolubilizer composition comprises glyoxal and at least one alkali metal orthophosphate and wherein the pH of the aqueous insolubilizer composition is below 7.

* * * * *